US011565142B2

(12) United States Patent
Henniger et al.

(10) Patent No.: US 11,565,142 B2
(45) Date of Patent: Jan. 31, 2023

(54) WEIGHT PLATE

(71) Applicant: Coulter Ventures, LLC., Columbus, OH (US)

(72) Inventors: William Henniger, Columbus, OH (US); Anahita Ameri, Columbus, OH (US); Dylan Jones, Santa Barbara, CA (US)

(73) Assignee: Coulter Ventures, LLC., Columbus, OH (US)

( * ) Notice: Subject to any disclaimer, the term of this patent is extended or adjusted under 35 U.S.C. 154(b) by 30 days.

(21) Appl. No.: 17/089,338

(22) Filed: Nov. 4, 2020

(65) Prior Publication Data

US 2021/0128969 A1 May 6, 2021

Related U.S. Application Data

(60) Provisional application No. 62/930,423, filed on Nov. 4, 2019.

(51) Int. Cl.
*A63B 21/06* (2006.01)
*A63B 21/072* (2006.01)

(52) U.S. Cl.
CPC ..... *A63B 21/0604* (2013.01); *A63B 21/0724* (2013.01); *A63B 21/0726* (2013.01)

(58) Field of Classification Search
CPC ..... A63B 21/0604; A63B 21/0724; A63B 21/0726; A63B 2071/0063; A63B 2209/00; A63B 21/0607; A63B 21/4035; A63B 21/0004; A63B 21/06; A63B 21/072–0728; A63B 21/0601–0606;
(Continued)

(56) References Cited

U.S. PATENT DOCUMENTS 1,033,056 A 7/1912 Richert
3,606,410 A 9/1971 Inserra
(Continued)

FOREIGN PATENT DOCUMENTS

AU 202013319 7/2020
AU 2019214909 A1 8/2020
(Continued)

OTHER PUBLICATIONS

Product listing for Rogue LB Competition Plates, From: http://web.archive.org/web/20180724000915/https:/www.roguefitness.com/rogue-competition-plates, dated Jun. 13, 2014, accessed Jun. 24, 2021.

(Continued)

*Primary Examiner* — Joshua Lee
*Assistant Examiner* — Catrina A Letterman
(74) *Attorney, Agent, or Firm* — Banner & Witcoff, Ltd.

(57) ABSTRACT

A weight plate includes a first section having an annular shape with a passage extending axially through the first section and configured to receive an elongated member therethrough, and a second section having an annular shape and positioned radially outward of the first section, where the second section includes first and second outer surfaces on opposite axial sides of the weight plate with an axial thickness defined between the first and second outer surfaces. The second section has a plurality of recesses each extending axially inward from the first and second outer surfaces at least partially through the axial thickness of the second section.

23 Claims, 10 Drawing Sheets

(58) Field of Classification Search
CPC .. A63B 21/00058–00065; B29D 30/02; B60C 7/102; B60C 7/12; B60C 17/06; B60C 7/18; B60C 17/061; B60C 2001/0091; B60C 7/00; B60C 7/107; B60C 7/22
See application file for complete search history.

(56) References Cited

U.S. PATENT DOCUMENTS 3,790,922 A 2/1974 Normann
4,482,151 A * 11/1984 Zwilling ..... A63B 21/0728 482/106
D279,495 S 7/1985 Barbeau
D280,433 S 9/1985 Lincir
D287,387 S 12/1986 Oliver et al.
4,639,979 A 2/1987 Polson
4,738,446 A 4/1988 Miles
4,773,641 A 9/1988 Metz
4,817,944 A 4/1989 Anderson et al.
4,893,810 A 1/1990 Lee
D314,422 S 2/1991 Adorjan
5,033,740 A 7/1991 Schwartz et al.
5,108,066 A 4/1992 Lundstrom
5,137,502 A 8/1992 Anastasi
5,163,887 A 11/1992 Hatch
D346,433 S 4/1994 Cooper
D354,322 S 1/1995 Vodhanel, Jr.
D355,007 S 1/1995 Rojas et al.
D394,685 S 5/1998 Eckmann
D405,484 S 2/1999 Rojas et al.
D406,183 S 2/1999 Zovich
D409,266 S 5/1999 Rojas et al.
D409,695 S 5/1999 Rojas et al.
6,014,078 A 1/2000 Rojas et al.
D421,076 S 2/2000 Lincir
D424,140 S 5/2000 Lincir
D424,639 S 5/2000 Rojas et al.
D428,947 S 8/2000 Harms et al.
D433,468 S 11/2000 Rojas et al.
D433,469 S 11/2000 Rojas et al.
D433,720 S 11/2000 Rojas et al.
D433,721 S 11/2000 Rojas et al.
D434,090 S 11/2000 Wallace et al.
D437,015 S 1/2001 Rojas et al.
D439,290 S 3/2001 Rojas et al.
D441,412 S 5/2001 Rojas et al.
D441,812 S 5/2001 Rojas et al.
D442,239 S 5/2001 Rojas et al.
D442,240 S 5/2001 Rojas et al.
D442,654 S 5/2001 Buchanan
D445,153 S 7/2001 Lincir
D445,154 S 7/2001 Lincir
D445,854 S 7/2001 Harms et al.
D446,265 S 8/2001 Lincir
D446,559 S 8/2001 Lincir
D448,055 S 9/2001 Lien et al.
D450,361 S 11/2001 Harms et al.
D451,158 S 11/2001 Lincir
D451,159 S 11/2001 Rojas et al.
D451,160 S 11/2001 Rojas et al.
6,319,176 B1 11/2001 Landfair
D454,167 S 3/2002 Lincir
6,436,015 B1 8/2002 Frasco et al.
D463,001 S 9/2002 Buchanan
D474,517 S 5/2003 Harms
D476,383 S 6/2003 Chen
D480,969 S 10/2003 Owens
D483,083 S 12/2003 Allshouse et al.
6,681,822 B2 1/2004 Adams et al.
6,702,723 B2 3/2004 Landfair
6,736,765 B2 5/2004 Wallace et al.
6,746,380 B2 6/2004 Lien et al.
D494,451 S 8/2004 Winig et al.
D496,414 S 9/2004 Harms et al.
6,837,833 B2 1/2005 Elledge
D502,514 S 3/2005 Buchanan et al.
6,875,161 B1 4/2005 Brice
D504,923 S 5/2005 Harms et al.
D511,366 S 11/2005 Brown
6,991,590 B2 1/2006 Vigiano
D516,639 S 3/2006 Hamilton
D519,584 S 4/2006 Brice et al.
7,198,591 B2 4/2007 Lien
7,207,929 B2 4/2007 Hamilton
7,300,389 B2 11/2007 Lien et al.
D562,415 S 2/2008 Xu et al.
D562,919 S 2/2008 Hillson
D566,207 S 4/2008 Cao
D566,208 S 4/2008 Alessandri et al.
D566,209 S 4/2008 Alessandri et al.
D568,423 S 5/2008 Y'shua et al.
D572,320 S 7/2008 Davies, III
D573,207 S 7/2008 Davies, III
D573,208 S 7/2008 Davies, III
7,517,305 B2 4/2009 Lien
D606,133 S 12/2009 Lien
7,625,322 B1 12/2009 Krull
D609,526 S 2/2010 Tuttle
D611,524 S 3/2010 Lawrence, III
7,704,196 B2 4/2010 Lien et al.
D615,605 S 5/2010 Frasco et al.
D628,248 S 11/2010 Januszek
7,828,702 B2 11/2010 Lien et al.
D631,142 S 1/2011 Angell
D637,697 S 5/2011 Steiner
D639,874 S 6/2011 Hillson
D643,075 S 8/2011 Childs
D660,928 S 5/2012 Guarrasi
D662,558 S 6/2012 Lovegrove et al.
8,282,138 B2 10/2012 Steiner
D673,230 S 12/2012 Qin
8,434,533 B2 5/2013 Albert et al.
D684,224 S 6/2013 Davies, III
D688,759 S 8/2013 Davies, III
D692,969 S 11/2013 Davies, III
D695,128 S 12/2013 Ozsinmaz
D722,348 S 2/2015 Kessler
D732,613 S 6/2015 Davies, III
D736,884 S 8/2015 Lovley, II et al.
9,109,616 B1 8/2015 Ballentine
D749,177 S 2/2016 Childs
D749,889 S 2/2016 Magistro
D751,157 S 3/2016 Irwin et al.
D751,940 S 3/2016 Vaughan et al.
9,358,414 B2 6/2016 Dephouse
9,364,704 B1 6/2016 Kuka
D763,658 S 8/2016 Grasselli et al.
D764,608 S 8/2016 Jones
D766,384 S 9/2016 Jones
D771,205 S 11/2016 Davies, III
9,504,869 B2 11/2016 Gavigan
D777,266 S 1/2017 Davies, III
D780,859 S 3/2017 Ramsey et al.
D780,860 S 3/2017 Jones
D780,861 S 3/2017 Jones
D788,886 S 6/2017 Salzer
9,682,268 B2 6/2017 Breitkreutz et al.
D795,971 S 8/2017 Patti
9,751,270 B2 9/2017 Thompson
D798,968 S 10/2017 Lien
D799,939 S 10/2017 Lowitz
D802,689 S 11/2017 Lien
D810,849 S 2/2018 Chong
D821,175 S 6/2018 Grasselli et al.
10,010,741 B2 7/2018 Rothschild et al.
10,040,259 B2 8/2018 Lister et al.
D831,134 S 10/2018 Hillson
D834,115 S 11/2018 Gilbert
D842,399 S 3/2019 Arceta
D842,941 S 3/2019 Brezovar
D843,524 S 3/2019 Henniger
10,226,659 B2 3/2019 Stilson
D851,711 S 6/2019 Brezovar
D852,637 S 7/2019 Becerra
D854,636 S 7/2019 Nelson

(56) References Cited

U.S. PATENT DOCUMENTS

| | | | | |
|---|---|---|---|---|
| D856,447 | S | 8/2019 | Dunahay | |
| D862,617 | S | 10/2019 | Henniger et al. | |
| D865,881 | S | 11/2019 | Muir et al. | |
| 10,537,777 | B1 | 1/2020 | Tash et al. | |
| 10,773,117 | B1 * | 9/2020 | Goldberg | A63B 21/0724 |
| D937,942 | S | 12/2021 | Rothschild | |
| D937,943 | S | 12/2021 | Rothschild | |
| 11,260,257 | B2 | 3/2022 | Rothschild | |
| 2001/0049324 | A1 * | 12/2001 | Wallace | A63B 21/0783 482/106 |
| 2003/0083179 | A1 * | 5/2003 | Landfair | A63B 21/072 482/93 |
| 2004/0077466 | A1 | 4/2004 | Wallace et al. | |
| 2004/0092370 | A1 * | 5/2004 | Lincir | A63B 21/072 482/93 |
| 2004/0166997 | A1 * | 8/2004 | Vigiano | A63B 21/072 482/106 |
| 2005/0026754 | A1 | 2/2005 | Lien et al. | |
| 2006/0073948 | A1 | 4/2006 | Lincir | |
| 2006/0211547 | A1 * | 9/2006 | Lien | A63B 21/0728 482/93 |
| 2006/0293155 | A1 | 12/2006 | Hamilton | |
| 2007/0027007 | A1 | 2/2007 | Frasco | |
| 2007/0138351 | A1 | 6/2007 | Wu | |
| 2007/0142188 | A1 | 6/2007 | Lien | |
| 2007/0184943 | A1 | 8/2007 | Davies | |
| 2008/0153678 | A1 | 6/2008 | McClusky | |
| 2008/0200316 | A1 | 8/2008 | Shillington | |
| 2008/0287271 | A1 | 11/2008 | Jones | |
| 2009/0048079 | A1 | 2/2009 | Nalley | |
| 2009/0118105 | A1 | 5/2009 | Schiff | |
| 2009/0192025 | A1 | 7/2009 | Minerva | |
| 2009/0239719 | A1 | 9/2009 | Patti | |
| 2009/0258766 | A1 | 10/2009 | Patti | |
| 2009/0270233 | A1 | 10/2009 | Cao | |
| 2010/0022359 | A1 * | 1/2010 | Lin | A63B 21/0724 482/93 |
| 2010/0125030 | A1 | 5/2010 | Shifferaw | |
| 2011/0021327 | A1 | 1/2011 | Lien | |
| 2012/0094810 | A1 | 4/2012 | Anderson | |
| 2012/0234444 | A1 | 9/2012 | Palinkas et al. | |
| 2013/0165300 | A1 | 6/2013 | Richards | |
| 2014/0024504 | A1 | 1/2014 | Potts et al. | |
| 2014/0162850 | A1 | 6/2014 | Chen | |
| 2014/0256521 | A1 | 9/2014 | Davies, III | |
| 2014/0274595 | A1 | 9/2014 | Patti | |
| 2015/0011369 | A1 | 1/2015 | Peritz | |
| 2015/0231441 | A1 | 8/2015 | Davies, III | |
| 2017/0113088 | A1 | 4/2017 | Hollingshead | |
| 2017/0149269 | A1 | 5/2017 | Rojas et al. | |
| 2017/0151460 | A1 | 6/2017 | Jennings et al. | |
| 2017/0258661 | A1 | 9/2017 | Bradford | |
| 2018/0028857 | A1 | 2/2018 | Rothschild et al. | |
| 2018/0272175 | A1 | 9/2018 | Henniger | |
| 2019/0038927 | A1 | 2/2019 | Wilhelm et al. | |
| 2019/0232100 | A1 * | 8/2019 | Rothschild | A63B 21/0607 |
| 2020/0171338 | A1 * | 6/2020 | Jones | A63B 21/0607 |
| 2020/0360755 | A1 * | 11/2020 | Rothschild | A63B 21/0607 |
| 2021/0275853 | A1 | 9/2021 | Rothschild | |

FOREIGN PATENT DOCUMENTS

| | | | | |
|---|---|---|---|---|
| AU | 202013335 | | 11/2020 | |
| AU | 202015921 | | 11/2020 | |
| CA | 3090106 | A1 | 8/2019 | |
| CN | 3191234 | | 6/2001 | |
| CN | 2512467 | * | 11/2001 | A63B 21/072 |
| CN | 2512467 | Y | 9/2002 | |
| CN | 303340060 | | 8/2015 | |
| CN | 303896560 | | 10/2016 | |
| CN | 304438760 | | 1/2018 | |
| CN | 305524546 | | 12/2019 | |
| CN | 111867685 | A | 10/2020 | |
| EM | 003110402-0001 | | 7/2016 | |
| EM | 007065669-0001 | | 10/2019 | |
| EM | 008003958-0002 | | 8/2020 | |
| EM | 008003958-0003 | | 8/2020 | |
| EM | 008003958-0001 | | 12/2020 | |
| EP | 3746191 | A1 | 12/2020 | |
| ES | 1038081 | U | 5/1998 | |
| WO | 2019152493 | A1 | 8/2019 | |

OTHER PUBLICATIONS

Product listing for Rogue Dumbbell Bumpers, From: http://web.archive.org/web/20180830044526/https:/www.roguefitness.com/rogue-dumbbell-bumpers, dated Aug. 30, 2018, accessed Jun. 24, 2021.

Product listing for Rogue Olympic Plates; from: http://web.archive.org/web/20190402011443/https://www.roguefitness.com/rogue-olympic-plates; dated Jun. 14, 2014, accessed Jul. 1, 2021.

Product listing for CAP 12-sided Olympic Rubber Coated Grip Plate from <https://web.archive.org/web/201 70621232634/http://capbarbell.com/cap-barbell-12-sided-2-rubber-grip-plate/>, dated Jun. 21, 2017.

Product listing for Rogue 6-Shooter Urethane Olympic Grip Plates from <https://web.archive.org/web/20170714033025/http://www.roguefitness.com:80/rogue-6-shooter-urethane-olympic-grip-plates>, dated Jul. 14, 2017.

CAP Barbell Weight Plates listing from <https://web.archive.org/web/20180103173524/http://capbarbell.com/strength/weight-plates>, dated Jan. 3, 2018.

BodyRip Premium Pro (2 x 10kg) Olympic-Grip Rubber Plates: Published Mar. 24, 2014 [online], site visited Dec. 1, 2019, Available from Internet URL: https://www.amazon.co.uk/dp/B00J7S8ZGC/ref-cm_sw_r_tw_dp_U_x_Xof5DbXRFZ5AC (Year: 2014).

Viavito Tri Grip Vinyl Standard Weight Plates: Published Mar. 17, 2016 [online], site visited Dec. 1, 2019. Available from Internet URL: https://www.amazon.co.uk/dp/B01D3U5RXI/ref=cm_sw_r_tw_dp_U_x_epf5Db1B78TVQ (Year: 2016).

Bodypower 10kg Tri Grip Vinyl Standard (1 Inch) Weight Disc Plates: Published Jun. 10, 2013 [online], site visited Dec. 1, 2019. Available from Internet URL: https://www.amazon.co.uk/dp/B00E4WH2NS/ref=cm_sw_r_tx_dp_U_x_Fpf5DbMHT60MN (Year: 2013).

BodyRip Olympic Polygonal Weight Plates: Published Feb. 3, 2015 [online], site visited Dec. 1, 2019. Available from Internet URL: https://www.amazon.co.uk/dp/B00T4GM5W2/ref=cm_sw_r_tw_dp_U_x_ASg5DbMR69J5P (Year: 2015).

BodyRip Polygonal Weight Plates 1 x 10kg BodyRip: Published Feb. 7, 2014 [online], site visited Dec. 1, 2019. Available from Internet URL: https://www.amazon.co.uk/dp/B00IARQAWW/ref=cm_sw_r_tw_dp_U_x_5I5DbXR685AX (Year: 2014).

Mar. 10, 2020 (WO) International Search Report & Written Oppinion PCT/US2019/064237.

Ignite by Spri Weight Plates: Published 2017 [online], site visited Dec. 1, 2019. Available from Internet URL: https://www.amazon.com/dp/B001F1Y1G/ref=cm_sw_r_tw_dp_U_x_MSN7DbQ/I67HB (Year: 2017).

Body Solid Rubber Grip Olympic Weight Plates (ORST255) Bodysolid: Published Feb. 2, 2009 [online], site visited Dec. 1, 2019. Available from Internet URL: https://www.amazon.com/dp/B001FIY17C/ref=cm_sw_r_tw_dp_U_x_MSN7DbQ7T67H8 (Year: 2009).

Product listing for 2" Deep Dish Olympic Weight Plates, from <https://yorkbarbell.com/product/deep-dish-olympic-plate/>, dated Jul. 7, 2020.

Product listing for Apollo Athletics Deep Dish Olympic Plates, from https://www.showmeweights.com/apollo-athletics-deep-dish-olympic-plates.html, dated Jul. 7, 2020.

Photo of Olympic Standard Barbell Weight Plates, from https://www.picclickimg.eom/d/l400/pict/132810172419_/Olympic-Standard-Barbell-Vintage-Deep-Dish-Weight-Plates.jpg, dated Jul. 7, 2020.

Product listing for 2" Hole Olympic Weights and Hampton Olympic Bars, from <https://www.google.com/url?sa=i&url=http%3A%2F%2Fwww.shoppok.com%2Ftoledo%2Fa%2C39%2C138616%2C2-hole-Olympic-Weights-and-Hampton-Olympic-bars-Ypsilanti-mi-

(56) References Cited

OTHER PUBLICATIONS

48197-.htm&psig=AOwVaw1beW0Nv1j4xfi64WvSomVK&ust=1592656917597000&source=images&cd=vfe&ved=0CAIQjRxqFwoTCMDE38HzjeoCFQAAAAAdAAAAABAJ>, dated Jul. 7, 2020.
Photo of York Olympic Standard Barbell Weight Plates, from https://external-preview.redd.it/3elL3ODNpQ8Rv7Xu1vfzNyPzFSSdljn9crrZ4i5T5-1.jpg?auto=webp&s=d87da24a6c3837e0e90f9c88b366c7781fb9f150, dated Jul. 7, 2020.
A Guide to Buying Steel Powerlifting Plates & Discs, from https://www.garage-gyms.com/steel-poweriifting-weight-plates-discs-guide-review/, dated Nov. 16, 2017.
Photo of York Barbell Weight Plates, from https://i.ebayimg.com/00/s/OTQzWDE2MDA=/z/FKEAAOSwi~deOkZI/$_3.JPG?set_id=8800005007, dated Jul. 7, 2020.
Photo of York Olympic Standard Barbell Weight Plate, from https://www.picclickimg.com/d/l400/pict/162970072869_/245-lbs-Vintage-Deep-Dish-York-made-in-USA-Olympic.jpg, dated Jul. 7, 2020.
Screen capture of Rogue Elephant Bar Deadlift—Full Live Stream | Arnold Strongman Classic 2020, from <https://www.youtube.com/watch?v=CuYsT9GeUmc&feature=emb_rel_pause>, dated Mar. 7, 2020.

* cited by examiner

WEIGHT PLATE

CROSS-REFERENCE TO RELATED APPLICATION

This application is a non-provisional of, and claims priority to, U.S. Provisional Application No. 62/930,423, filed Nov. 4, 2019, which prior application (including the Appendix filed therewith) is incorporated by reference herein in its entirety.

FIELD OF THE INVENTION

This disclosure relates to weight plates for use in weightlifting exercises, and more specifically to weight plates with features for reducing noise and/or vibration when the weight plate is dropped from an elevated position.

BACKGROUND

Weightlifting exercises are performed in a large variety of different settings, including large gyms, small gyms, homes, among many other locations. Such settings may be located in an area where loud noise is a potential issue, such as within a home or residential area or close to another business. Weight plates are one of the most frequently used types of weightlifting equipment. In some exercises, barbells weighted with weight plates are dropped from a height to the ground, such as from waist height, shoulder height, head height, etc., and such dropping can create significant noise. There is a need for providing a weight plate that reduces the noise emitted when dropping the weight plates from a height, while also retaining plate durability and safety.

The present disclosure is provided to address this need and other needs in existing weight plates. A full discussion of the features and advantages of the present invention is deferred to the following detailed description, which proceeds with reference to the accompanying drawings.

BRIEF SUMMARY

Aspects of the disclosure relate to a weight plate that includes an outer body formed of a first material and an inner body formed of a second material having a larger density and lower flexibility than the first material. The outer body includes an inner section having an annular shape with a passage extending axially through the inner section and configured to receive an elongated member therethrough, the inner section having a first axial thickness, a middle section having an annular shape and positioned radially outward of the inner section, the middle section including first and second outer surfaces on opposite axial sides of the outer body, with a second axial thickness defined between the first and second outer surfaces, and an outer section having an annular shape and positioned radially outward of the middle section and forming an outer radial periphery of the weight plate, where the outer section has a third axial thickness. The first axial thickness and the third axial thickness are greater than the second axial thickness. The inner body is contained within the inner section of the outer body. The middle section has a plurality of recesses extending axially inward from the first and second outer surfaces through a portion of the second axial thickness, and the plurality of recesses include a plurality of first-shaped recesses having a first peripheral shape with a first number of sides and a plurality of second-shaped recesses having a second peripheral shape that is different than the first peripheral shape and with a second number of sides that is different from the first number of sides. Each of the first-shaped recesses on the first outer surface is axially aligned with another of the first-shaped recesses on the second outer surface to form a pair of first-shaped recesses separated by a first inner wall, and each of the second-shaped recesses on the first outer surface is axially aligned with another of the second-shaped recesses on the second outer surface to form a pair of second-shaped recesses separated by a second inner wall.

According to one aspect, the outer body surrounds the inner body on at least both axial sides and an outer radial side thereof.

According to another aspect, the inner body is formed of a single piece, and the outer body is molded around the inner body as a single piece.

According to a further aspect, the plurality of recesses further include a plurality of third-shaped recesses having a third peripheral shape that is different from the first peripheral shape and the second peripheral shape and a third number of sides that is different from the first number of sides and the second number of sides.

According to yet another aspect, the first-shaped recesses each have a first perimeter defined at the first or second outer surface and a first volume, and the second-shaped recesses each have a second perimeter defined at the first or second outer surface that is different from the first perimeter and a second volume that is different from the first volume.

Additional aspects of the disclosure relate to a weight plate that includes a first section having an annular shape with a passage extending axially through the first section and configured to receive an elongated member therethrough, and a second section having an annular shape and positioned radially outward of the first section, where the second section includes first and second outer surfaces on opposite axial sides of the weight plate with an axial thickness defined between the first and second outer surfaces. The second section has a plurality of first recesses each extending axially inward from the first outer surface partially through the axial thickness of the second section to a first end recessed from the first outer surface, and a plurality of second recesses each extending axially inward from the second outer surface partially through the axial thickness of the second section to a second end recessed from the second outer surface. Each of the first recesses is axially aligned with one of the second recesses to form an aligned pair of recesses, such that an inner wall separates the first and second recesses of each aligned pair of recesses and defines the first and second ends of the first and second recesses of each aligned pair of recesses.

According to one aspect, the first and second recesses of each aligned pair of recesses have identical sizes and shapes. In one configuration, the plurality of first recesses and the plurality of second recesses each include a plurality of first-shaped recesses having a first shape and a plurality of second-shaped recesses having a second shape that is different from the first shape, where each first-shaped recess of the plurality of first recesses is axially aligned with one of the first-shaped recesses of the plurality of second recesses, and each second-shaped recess of the plurality of first recesses is axially aligned with one of the second-shaped recesses of the plurality of second recesses. In a further configuration, the plurality of first recesses and the plurality of second recesses each further include a plurality of third-shaped recesses having a third shape that is different from the first shape and the second shape, and wherein each third-shaped recess of the plurality of first recesses is axially aligned with one of the third-shaped recesses of the plurality of second recesses.

According to another aspect, each of the first recesses and each of the second recesses extend through less than half of the axial thickness of the second section.

According to a further aspect, the weight plate further includes a third section having an annular shape and positioned radially outward of the second section and forming an outer radial periphery of the weight plate. In one configuration, the third section has a greater axial thickness than the second section.

According to a still further aspect, the weight plate further includes an inner body having a larger density than a material forming the first and second outer surfaces, wherein the inner body is contained within the inner section.

According to yet another aspect, the second section is positioned immediately radially outward of the first section and is adjacent to the first section.

Further aspects of the disclosure relate to a weight plate including a first section having an annular shape with a passage extending axially through the first section and configured to receive an elongated member therethrough, and a second section having an annular shape and positioned radially outward of the first section, where the second section includes first and second outer surfaces on opposite axial sides of the weight plate with an axial thickness defined between the first and second outer surfaces. The second section has a plurality of recesses extending axially inward from at least one of the first and second outer surfaces through at least a portion of the second axial thickness, and the plurality of recesses comprise a plurality of first-shaped recesses having a first peripheral shape with a first number of sides and a plurality of second-shaped recesses having a second peripheral shape that is different than the first peripheral shape and with a second number of sides that is different from the first number of sides.

According to one aspect, the first peripheral shape is a first polygonal shape, and the second peripheral shape is a second polygonal shape, and the first and second polygonal shapes each comprise a plurality of flat, planar sides that extend axially inward and are joined by a plurality of corners defined therebetween.

According to another aspect, the plurality of recesses further includes a plurality of third-shaped recesses having a third peripheral shape that is different from the first peripheral shape and the second peripheral shape and a third number of sides that is different from the first number of sides and the second number of sides.

According to a further aspect, the first-shaped recesses extend axially inward from both of the first and second outer surfaces, and the second-shaped recesses extend axially inward from both of the first and second outer surfaces. In one configuration, each of the first-shaped recesses on the first outer surface is axially aligned with another of the first-shaped recesses on the second outer surface to form a pair of first-shaped recesses separated by a first inner wall, and each of the second-shaped recesses on the first outer surface is axially aligned with another of the second-shaped recesses on the second outer surface to form a pair of second-shaped recesses separated by a second inner wall.

According to yet another aspect, the first-shaped recesses each have a first volume and the second-shaped recesses each have a second volume that is different from the first volume.

According to a still further aspect, the first-shaped recesses each have a first perimeter defined at the first or second outer surface, and the second-shaped recesses each have a second perimeter defined at the first or second outer surface that is different from the first perimeter.

Still further aspects of the disclosure relate to a weight plate including an outer body formed of a first material and an inner body formed of a second material having a larger density and lower flexibility than the first material. The outer body includes a first section having an annular shape with a passage extending axially through the first section and configured to receive an elongated member therethrough, and a second section having an annular shape and positioned radially outward of the first section, where the second section includes first and second outer surfaces on opposite axial sides of the outer body, with an axial thickness defined between the first and second outer surfaces, and a plurality of recesses extending axially inward from at least one of the first and second outer surfaces through at least a portion of the axial thickness. The inner body is contained within the first section of the outer body, such that the outer body surrounds the inner body on at least both axial sides and an outer radial side thereof. The weight plate further includes a hub surrounding the passage, where the hub is engaged with an inner radial side of the inner body.

According to one aspect, the first material is or contains one or more polymer materials, and the second material is or contains one or more metallic materials.

According to another aspect, the inner body is formed of a single piece, and the outer body is molded around the inner body as a single piece.

According to a further aspect, the hub is integrally formed as part of the inner body and is formed of the second material.

According to yet another aspect, the ratio of a mass of the inner body to a mass of the outer body may vary by the weight of the weight plate. As one example, the weight plate may have a weight of 25 pounds, and this ratio is from 0.42 to 0.78. As another example, the weight plate may have a weight of 35 pounds, and this ratio is from 0.84 to 1.56. As a further example, the weight plate may have a weight of 45 pounds, and this ratio is from 0.77 to 1.43.

Yet additional aspects of the disclosure relate to a weight plate that includes a first section having an annular shape with a passage extending axially through the first section and configured to receive an elongated member therethrough, and a second section having an annular shape with a circular inner periphery and a circular outer periphery and positioned radially outward of the first section, where the second section includes first and second outer surfaces on opposite axial sides of the weight plate with an axial thickness defined between the first and second outer surfaces. The second section has a plurality of recesses extending axially inward from the first and second outer surfaces at least partially through the axial thickness of the second section. The axial thickness of portions of the second section surrounding the recesses is constant between the inner periphery and the outer periphery. A total volume occupied by the plurality of recesses between the first and second outer surfaces is from 20% to 30% of a total volume of solid material in the second section between the inner periphery and the outer periphery. In another configuration, the total volume occupied by the plurality of recesses between the first and second outer surfaces is from 22-28% of the total volume of solid material in the second section between the inner periphery and the outer periphery. In a further configuration, the total volume occupied by the plurality of recesses between the first and second outer surfaces is about 25% of the total volume of solid material in the second section between the inner periphery and the outer periphery.

According to one aspect, the plurality of recesses includes a plurality of first recesses each extending axially inward from the first outer surface partially through the axial thickness of the second section to a first end recessed from the first outer surface, and a plurality of second recesses each extending axially inward from the second outer surface partially through the axial thickness of the second section to a second end recessed from the second outer surface. In one configuration, each of the first recesses is axially aligned with one of the second recesses to form an aligned pair of recesses, such that an inner wall separates the first and second recesses of each aligned pair of recesses and defines the first and second ends of the first and second recesses of each aligned pair of recesses. In another configuration, the first and second recesses of each aligned pair of recesses may have identical sizes and shapes.

According to another aspect, the weight plate further includes a third section having an annular shape and positioned radially outward of the second section and forming an outer radial periphery of the weight plate, where the third section has a greater axial thickness than the second section. In one configuration, the second section is positioned immediately radially outward of the first section and is adjacent to the first section, and the third section is positioned immediately radially outward of the second section and is adjacent to the second section, such that the third section extends from the second section to the outer radial periphery of the weight plate.

According to a further aspect, each of the plurality of recesses has a constant shape along an entire axial length of the respective recess.

Further aspects of the disclosure relate to a weight plate including a weight plate body having an outer periphery, a first outer surface and a second outer surface on opposite axial sides of the weight plate body, and a passage extending axially through the weight plate body and configured to receive an elongated member therethrough, where the first surface and the second surface extend from the passage radially outward to the outer periphery, and a plurality of recesses extending axially inward from the first and second outer surfaces at least partially through the axial thickness of the second section. A total volume occupied by the plurality of recesses between the first and second outer surfaces is from 6% to 13% of a total volume of solid material in the weight plate between the passage and the outer periphery.

According to one aspect, the weight plate body has an axial thickness defined between the first outer surface and the second outer surface, and the plurality of recesses includes a plurality of first recesses each extending axially inward from the first outer surface partially through the axial thickness of the weight plate body to a first end recessed from the first outer surface, and a plurality of second recesses each extending axially inward from the second outer surface partially through the axial thickness of the weight plate body to a second end recessed from the second outer surface. In one configuration, each of the first recesses is axially aligned with one of the second recesses to form an aligned pair of recesses, such that an inner wall separates the first and second recesses of each aligned pair of recesses and defines the first and second ends of the first and second recesses of each aligned pair of recesses. In another configuration, the first and second recesses of each aligned pair of recesses have identical sizes and shapes.

According to another aspect, the weight plate body includes a first section having an annular shape with the passage extending axially through the first section, a second section having an annular shape and positioned radially outward of the first section, and a third section having an annular shape and positioned radially outward of the second section and forming an outer radial periphery of the weight plate. In one configuration, the third section has a greater axial thickness than the second section, and the plurality of recesses are formed in the second section.

According to a further aspect, each of the plurality of recesses has a constant shape along an entire axial length of the respective recess.

Other aspects of the disclosure relate to a weightlifting apparatus including a weight mount connected to a gripping member, such as a barbell or dumbbell, with one or more weight plates as described herein mounted on the weight mount.

Still other aspects of the disclosure relate to a method of manufacturing a weight plate as described herein, including providing an inner body made at least partially from a first material and molding an outer body in connection with, and optionally at least partially surrounding, the inner body. The outer body may be made from a second material that is more flexible and less dense than the first material of the inner body.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
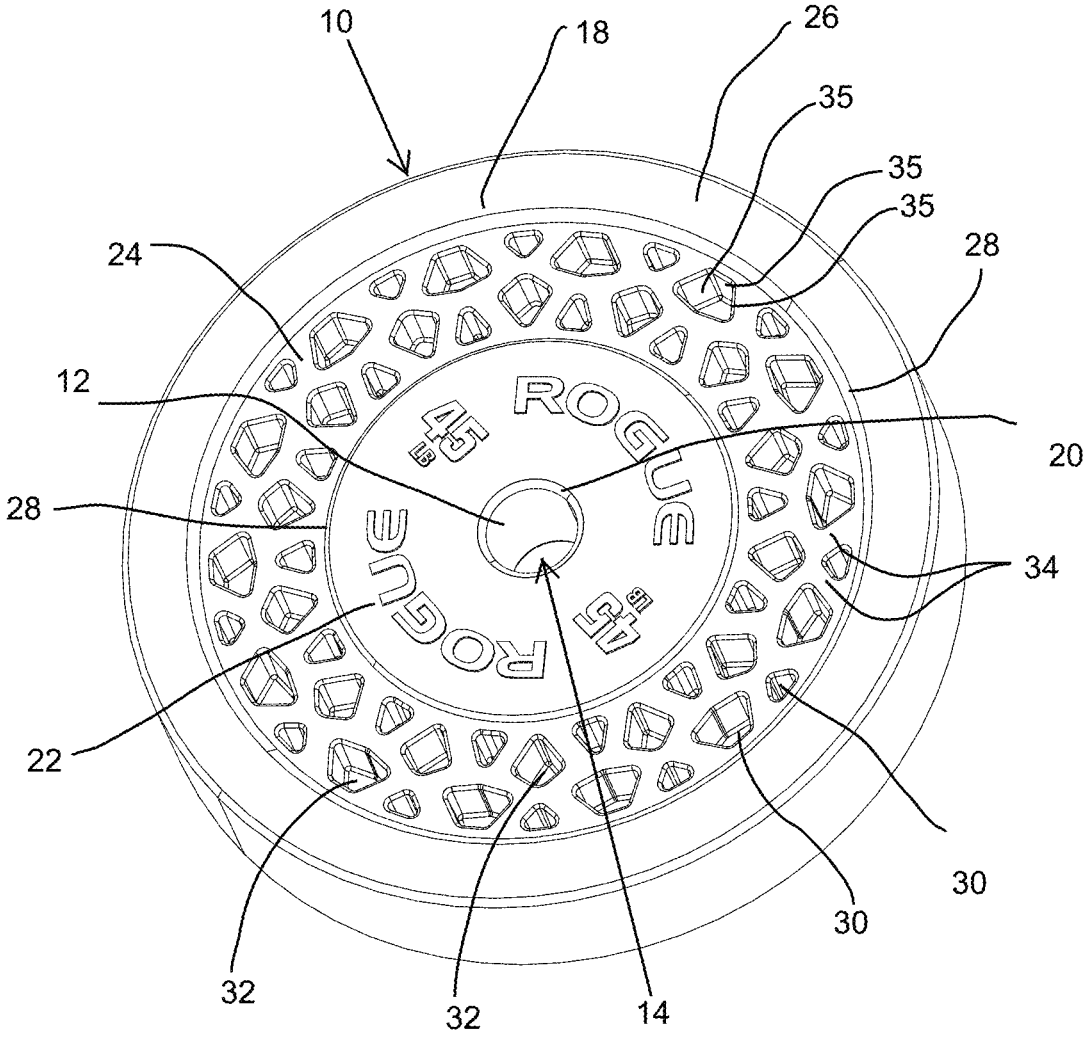
FIG. 1 is a perspective view of one embodiment of a weight plate according to aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 10:
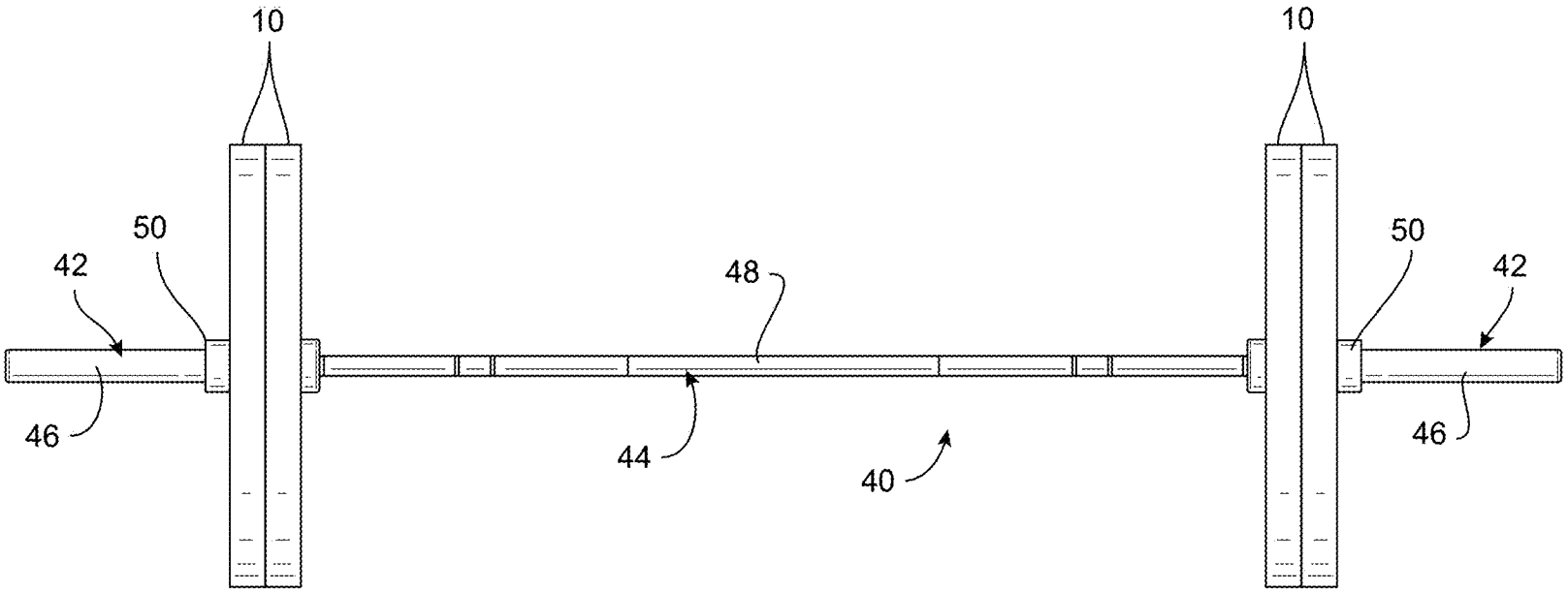
FIG. 10 is a plan view of one embodiment of a weightlifting apparatus in the form of a barbell having weight plates as shown in FIGS. 1-4 engaged with the barbell.

FIGS. 1-4 illustrate an example embodiment of a weight plate 10 according to aspects of the present disclosure, which includes a hub 12 defining a passage 14, an inner body 16, and an outer body 18 extending radially and/or axially outward of the inner body 16. The hub 12 and the passage 14 are configured for mounting the weight plate 10 as known in the art, such as by receiving a portion of a barbell or other weight mount therein for use in a weightlifting exercise. FIG. 10 illustrates a weightlifting apparatus 40 in the form of a barbell, which includes two weight mounts 42 in the form of barbell sleeves 46 connected to opposite ends of a gripping member 44 in the form of a bar 48, with two weight plates 10 as shown in FIGS. 1-4 removably mounted on each of the barbell sleeves 46. Each of the barbell sleeves 46 is inserted through the passage 14 of the weight plate 10 in this configuration. Additionally, barbell collars 50 are engaged with each of the barbell sleeves 46 to hold the weight plates 10 in place.

The hub 12 may have flanged and/or beveled ends 20 in order to ease insertion of a barbell or other weight mount. The inner body 16 is positioned radially outward of the hub 12, and the inner radial side of the inner body 16 may be engaged with or connected to the hub 12 in one embodiment. The hub 12 is formed as a separate piece from the inner body 16 in FIGS. 1-4, but may be integrally formed as part of the inner body 16 in another embodiment. It is understood that the hub 12 and the inner body 16 may be formed of the same material in this configuration. The hub 12 may be designed for durability and low friction properties. In one embodiment, the hub 12 may be formed of stainless steel.

The inner body 16 is formed of a metal, e.g., cast iron or steel in one embodiment, and is configured to provide mass to the weight plate 10. The inner body 16 may be formed of a different material or materials in other embodiments, and it is understood that the material(s) forming the inner body 16 may have a greater density than the material forming the outer body 18. The inner body 16 is completely encased by the hub 12 and the outer body 18 in the embodiment of FIGS. 1-4, and the outer body 18 surrounds the inner body 16 in both the outer radial direction and the axial direction, i.e., on the outer radial side and both axial sides of the inner body 16. In another embodiment, the inner body 16 may be partially or completely exposed on the axial faces, such that the outer body 18 surrounds the inner body 16 radially but not axially. It is understood that if the hub 12 is part of the inner body 16, then a portion of the inner body 16 including at least the hub 12 may be exposed.

In one embodiment, the outer body 18 includes at least two sections 22, 24, 26 that are radially disposed with respect to each other. These sections 22, 24, 26 may be referred to as a first section, a second section, a third section, etc. The outer body 18 in the embodiment of FIGS. 1-4 includes three sections: an inner section 22 that surrounds and contains the inner body 16, a middle section 24 positioned immediately radially outward of the inner section 22, and an outer section or outer rim 26 positioned immediately radially outward of the middle section 24 and forming the outer periphery of the weight plate 10. In the embodiment of FIGS. 1-4, the axial thickness of the weight plate 10 is greatest at the outer rim 26 and smallest at the middle section 24. This is illustrated in FIG. 4, where the thickness T1 at the outer section 26 and the thickness T4 at the inner section 22 are both greater than the thickness T2 at the middle section 24. The thickness T1 of the outer section 26 and the thickness T4 at the inner section 22 may be equal in one embodiment, or one of the inner section 22 or the outer section 26 may have a slightly greater thickness than the other. In the embodiments of FIGS. 1-8, the thickness T1 of the outer section 26 is greater than the thickness T4 of the inner section 22. The transitions 28 between the inner, middle, and outer sections 22, 24, 26 are beveled or gradual. Each of the sections 22, 24, 26 may have a constant axial thickness T1, T2, T4 over the substantial entirety thereof (i.e., between the inner and outer periphery thereof), such as in the embodiment of FIGS. 1-4. It is understood that the "constant axial thickness" is defined by the general contour of the outer surfaces 31, 33 of the plate 10 or a section thereof. Accordingly, a section may be considered to have a "constant axial thickness" and still have slight variations, such as the thickness variations caused by the raised letters and numbers on the inner section 22 in FIGS. 1-4. Additionally, a section may be considered to have a "constant axial thickness" despite the presence of numerous recesses 30 as disclosed herein, if the thickness defined by the outer surfaces 31, 33 (i.e., the material surrounding the recesses 30) is constant. In another embodiment, the outer body 18 may include only two sections, including an inner section 22 and an outer section 24, 26 positioned radially outward of the inner section 22, such that the inner section 22 has a constant axial thickness and the outer section 24, 26 has a constant axial thickness that is larger or smaller than the axial thickness of the inner section 22. In a further embodiment, the outer body 18 may include more than the three sections 22, 24, 26 illustrated in FIGS. 1-4, such that the outer body 18 has more than one middle section.

The outer body 18 may be formed of a single material and/or a single piece in one embodiment. In the embodiment of FIGS. 1-4, the outer body 18 is molded around the inner body 16 and formed of a rubber material. The material of the outer body 18 may be relatively soft, to provide sound and vibration damping and impact absorbing properties, such as having a hardness of 50-80 Shore A. In another embodiment, the material of the outer body 18 may be a rubber material having a hardness of 70-90 Shore A, which provides sound and vibration damping and impact absorbing properties. An ethylene propylene diene monomer (EPDM) rubber may be used as the rubber material of the outer body 18 in one embodiment.

The middle section 24 of the outer body 18 in FIGS. 1-4 includes a plurality of recesses 30 extending inward from opposed front and rear surfaces 31, 33. The recesses 30 in this embodiment are generally equal in depth but have different sizes and shapes. The recesses 30 may have multiple different polygonal shapes having different numbers of sides in one embodiment. In one embodiment, the recesses 30 may include "groups" of recesses all having the same shapes and/or the same number of sides. For example, the recesses 30 may include at least first-shaped recesses 30A having a first shape, size, volume, surface perimeter, and/or number of sides and second-shaped recesses 30B having a second shape, size, volume, surface perimeter, and/or number of sides, and may further include third-shaped recesses 30C having a third shape, size, volume, surface perimeter, and/or number of sides, or potentially additional recess groups. In the embodiment of FIGS. 1-4, the recesses include small triangular recesses 30A all having the same shape, size, volume, surface perimeter, and number of sides, mid-sized quadrilateral recesses 30B all having the same shape, size, volume, surface perimeter, and number of sides, and large pentagonal recesses 30C all having the same shape, size, volume, surface perimeter, and number of sides, each with rounded corners. These recesses 30 may be considered first-shaped recesses 30A, second-shaped recesses 30B, and third-shaped recesses 30C as described herein, and these groups are identified in FIGS. 2-3. In other embodiments, other shapes of recesses 30 having different numbers of sides may be used, including single-sided recesses (e.g., circle, ellipse), two-sided recesses (e.g., pointed oval), and/or recesses having more than five sides. Each recess 30 in FIGS. 1-4 has a constant shape, e.g., the same peripheral size and shape, along its entire axial length/depth, and this size and shape is the same as the surface shape and perimeter, i.e., the shape and perimeter defined at the surface 31, 33 of the plate 10.

Figure 2:
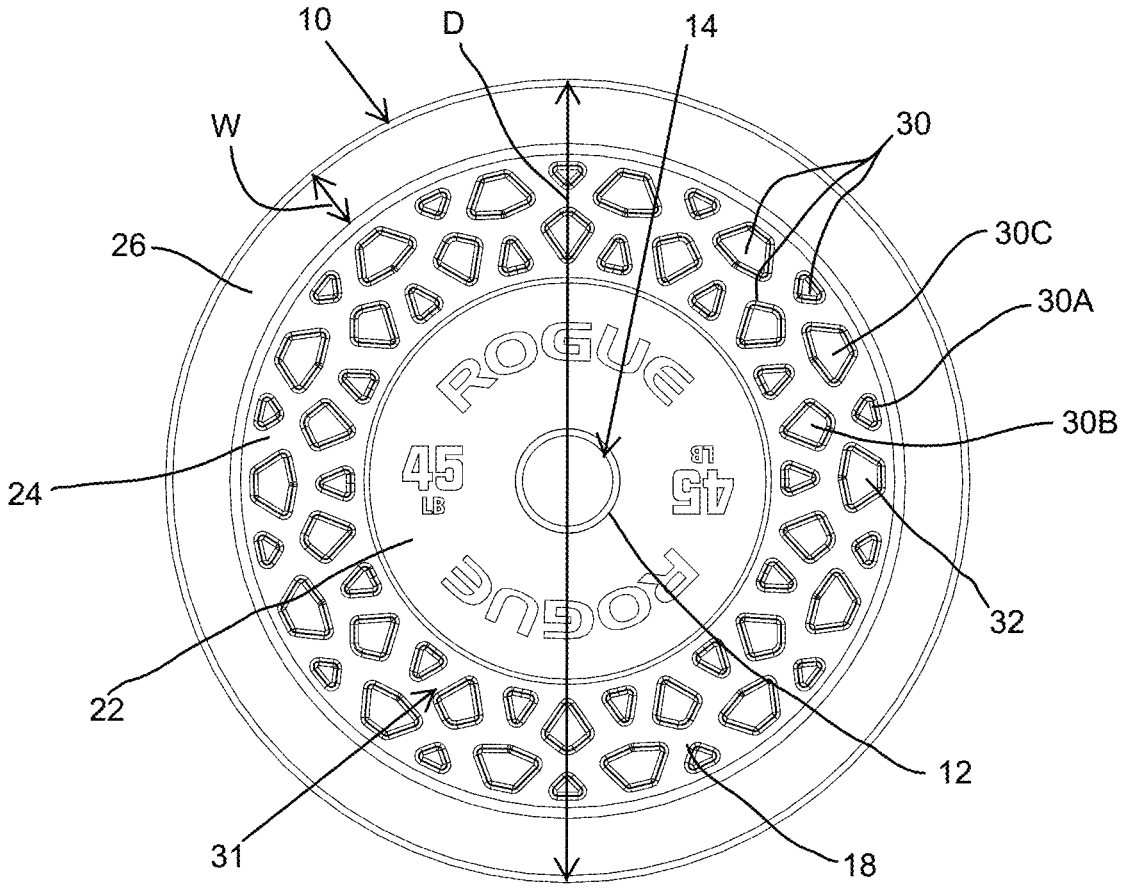
FIG. 2 is a front view of the weight plate of FIG. 1.
Figure 3:
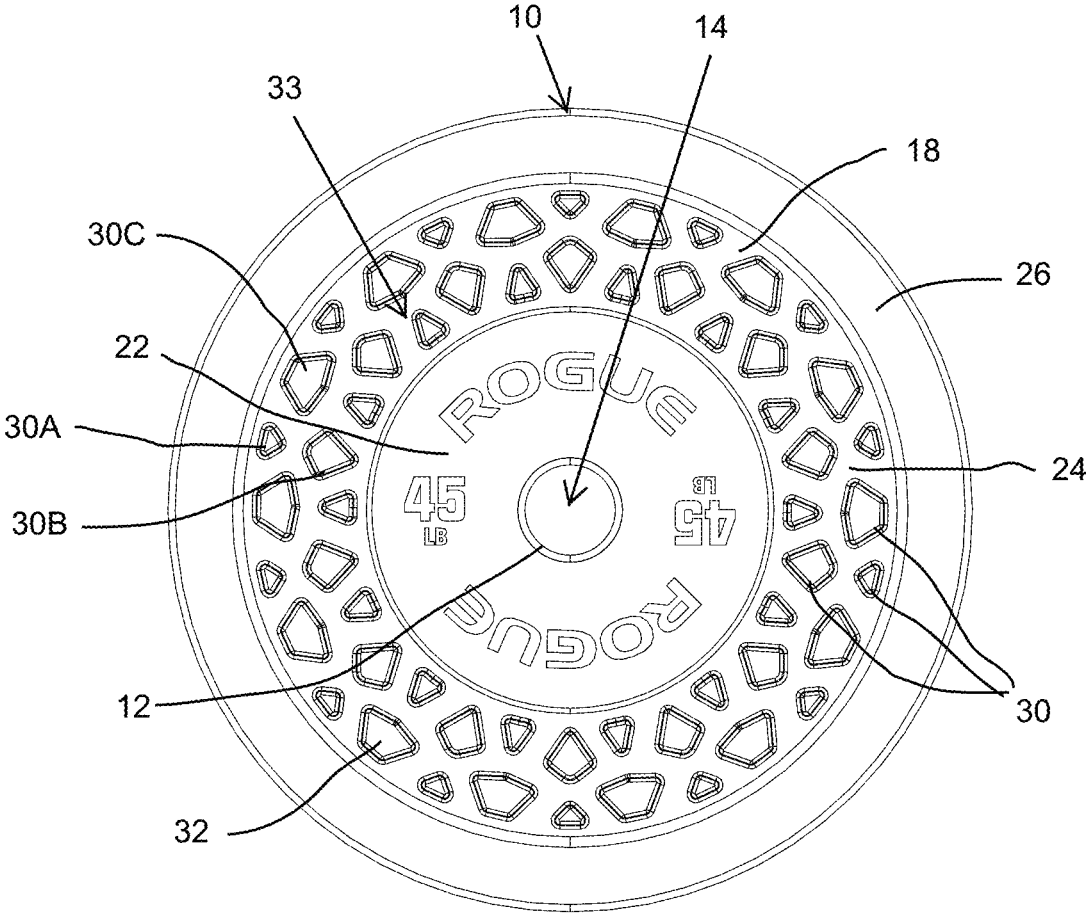
FIG. 3 is a rear view of the weight plate of FIG. 1.
Figure 4:
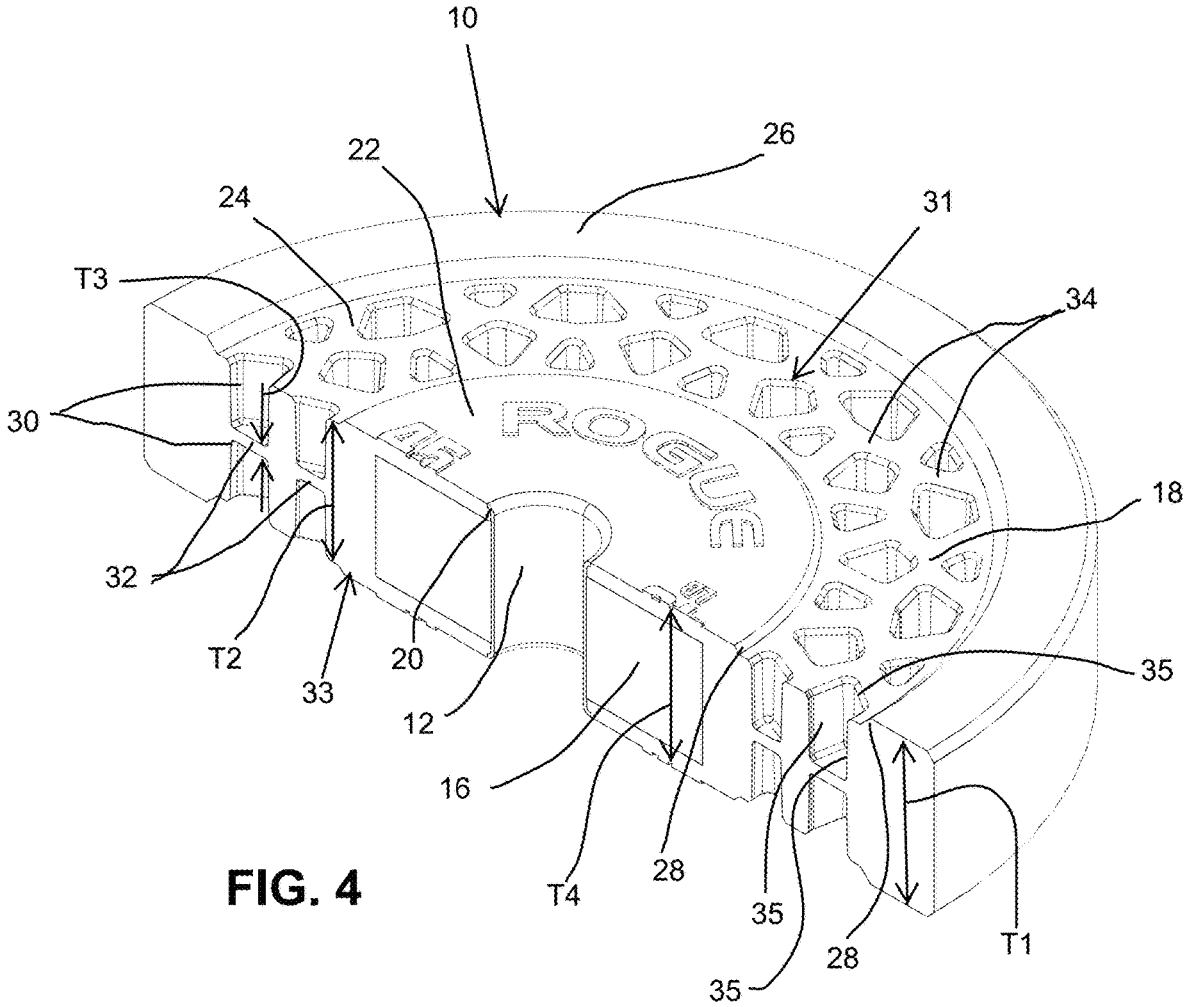
FIG. 4 is a cross-section view of the weight plate of FIG. 1.

As shown in FIGS. 2-3, the recesses 30 on both the front and rear surfaces 31, 33 have identical shapes and arrangements, such that each recess 30 on the front surface 31 is aligned with an identically sized and shaped recess 30 extending inward in the opposite direction from the rear surface 33. As shown in FIGS. 1-4, the recesses 30 are arranged such that each of the front and rear surfaces 31, 33 has first-shaped (triangular) recesses 30A, second-shaped (quadrilateral) recesses 30B, and third-shaped (pentagonal) recesses 30C distributed thereon in identical patterns. In this configuration, each first-shaped recess 30A on the front surface 31 is axially aligned with a first-shaped recess 30A on the rear surface 33, each second-shaped recess 30B on the front surface 31 is axially aligned with a second-shaped recess 30B on the rear surface 33, and each third-shaped recess 30C on the front surface 31 is axially aligned with a third-shaped recess 30C on the rear surface 33. These opposed recesses 30 are separated by inner walls 32 as shown in FIG. 4, and the inner walls 32 may all be of equal thickness T3 in one embodiment. Each recess 30 in FIGS. 1-4 has a plurality of generally flat walls or sides 35 extending inwardly from the outer surface 31, 33, which are arranged to intersect at angles to each other. The intersections between the walls 35 are formed by rounded corners in FIGS. 1-4. The recesses 30 may have a variety of different depths in other embodiments, such that the inner walls 32 have different axial thicknesses T3. Viewed another way, the middle section 24 may be considered to include a plurality of interconnected raised areas or ridges 34 extending between the outer rim 28 and the inner section 22. In other embodiments, the arrangements of the recesses 30 may be different, and may not be identical or symmetrical. In a further embodiment, some or all of the recesses 30 may be formed as passages that extend completely through the middle section 24, from the front surface 31 to the rear surface 33. The configuration of the recesses 30 in the middle section 24 provides additional sound and vibration damping and impact absorbing properties.

Figure 7:
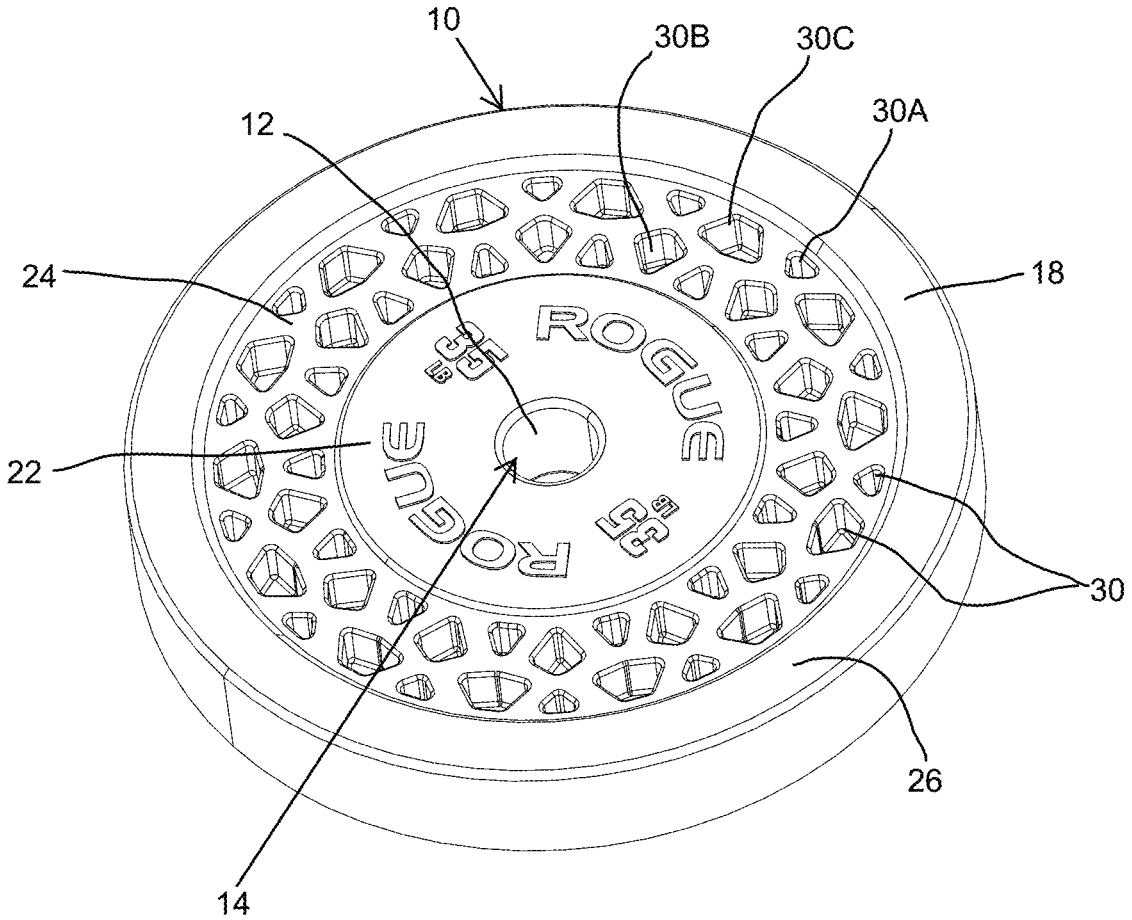
FIG. 7 is a perspective view of another embodiment of a weight plate according to aspects of the disclosure.
Figure 8:
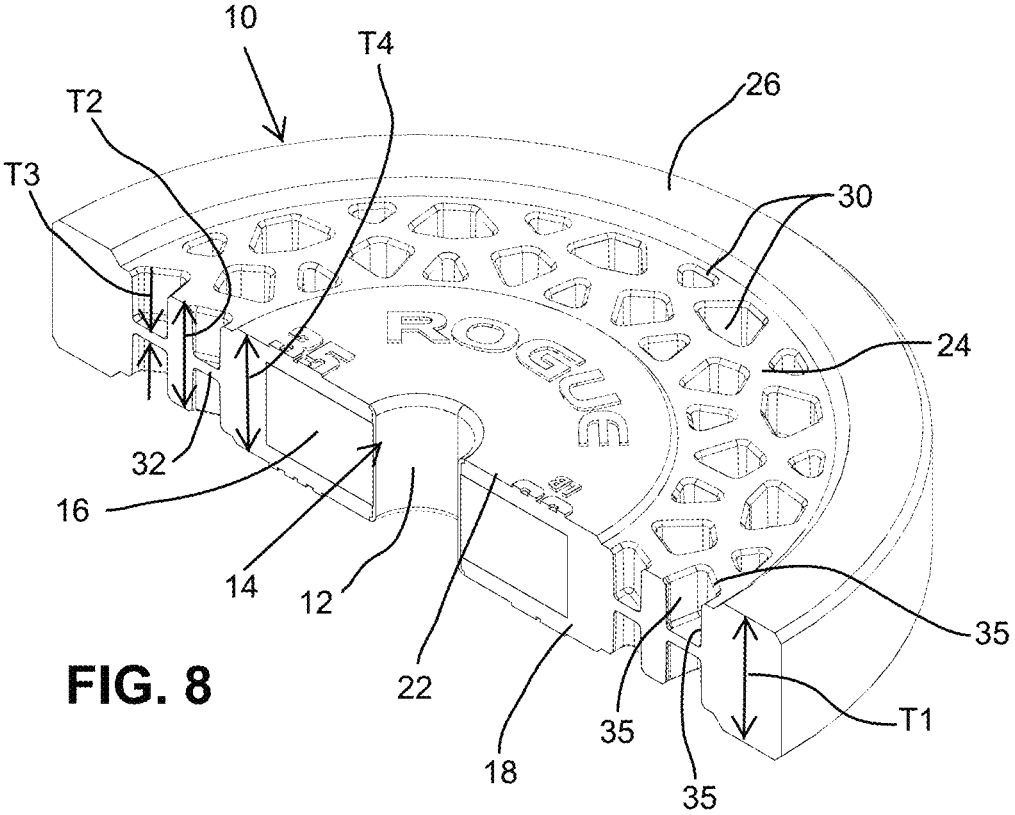
FIG. 8 is a cross-section view of the weight plate of FIG. 7.
Figure 9:
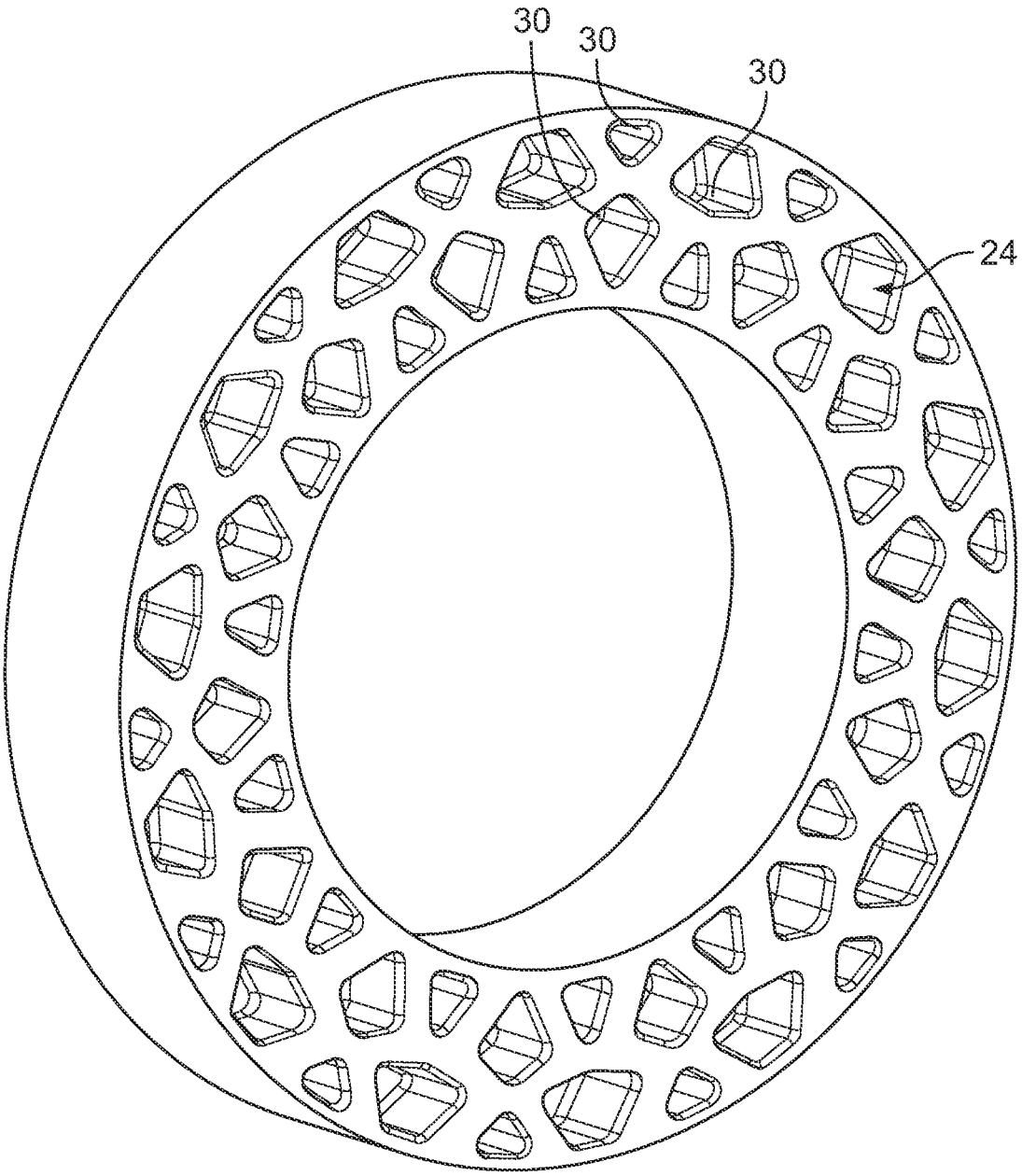
FIG. 9 is a perspective view of a section of the weight plate of FIGS. 1-4.

The sizes, depths, spacing, shapes, and distribution of the recesses 30 are configured to produce a desired combination of sound and vibration reduction, bounce height, and durability when the weight plate 10 is dropped. Too great a bounce height may present safety issues, as the weight may bounce unpredictably and cause injury. In general, greater flexibility and compressibility of the material surrounding the recesses 30 (i.e., a greater proportional volume of the recesses 30 relative to the surrounding material) produces greater sound and vibration reduction, but a higher bounce height when the weight plate 10 is dropped to sustain a radial impact force, and may decrease durability. Conversely, less flexibility and compressibility of the material surrounding the recesses 30 (i.e., a smaller proportional volume of the recesses 30 relative to the surrounding material) produces less sound and vibration reduction, but a lower bounce height when the weight plate 10 is dropped to sustain a radial impact force, and may have increased durability. The desired combination of durability, bounce height, and sound/vibration reduction may be different depending on the desired use of the weight plate 10. In one embodiment, the recesses 30 may be distributed across a section of the outer body 18 having a constant axial thickness, e.g., the middle section 24 in FIGS. 1-4, and the total volume of the recesses 30 (between the front and rear surfaces 31, 33) is from 20-30%, or from 22-28%, or about 25%, of the volume of material in the middle section 24. FIG. 9 illustrates the isolated middle section 24 of the outer body 18 in FIGS. 1-4, which forms the basis for these figures. In another embodiment, the total volume of the recesses 30 (between the front and rear surfaces 31, 33) is from 6-13%, or from 8-11%, or about 9.5%, of the volume of material in the entire weight plate 10. The volume ratios of the plates 10 in FIGS. 5-8 are the same as in FIGS. 1-4. It is also shown, e.g., in FIGS. 1-4, that immediately adjacent recesses on the front and rear sides 31, 33 have flat sides 35 that are generally parallel with the closest adjacent side 35 of each adjacent recess 30, in order to create consistent wall thickness of the material separating the adjacent recesses 30. This, in turn, creates consistent and predictable compression of the material surrounding the recesses 30.

Figure 5:
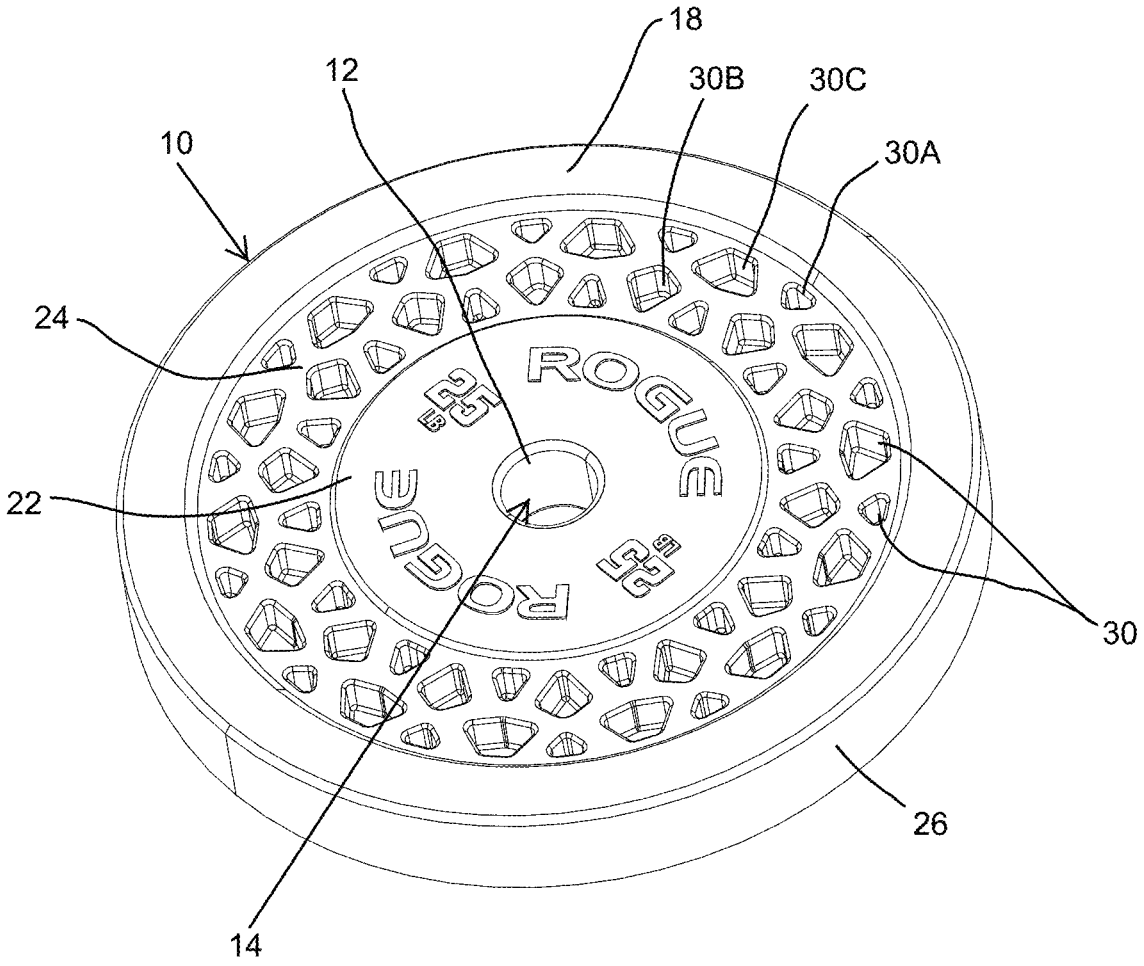
FIG. 5 is a perspective view of another embodiment of a weight plate according to aspects of the disclosure.
Figure 6:
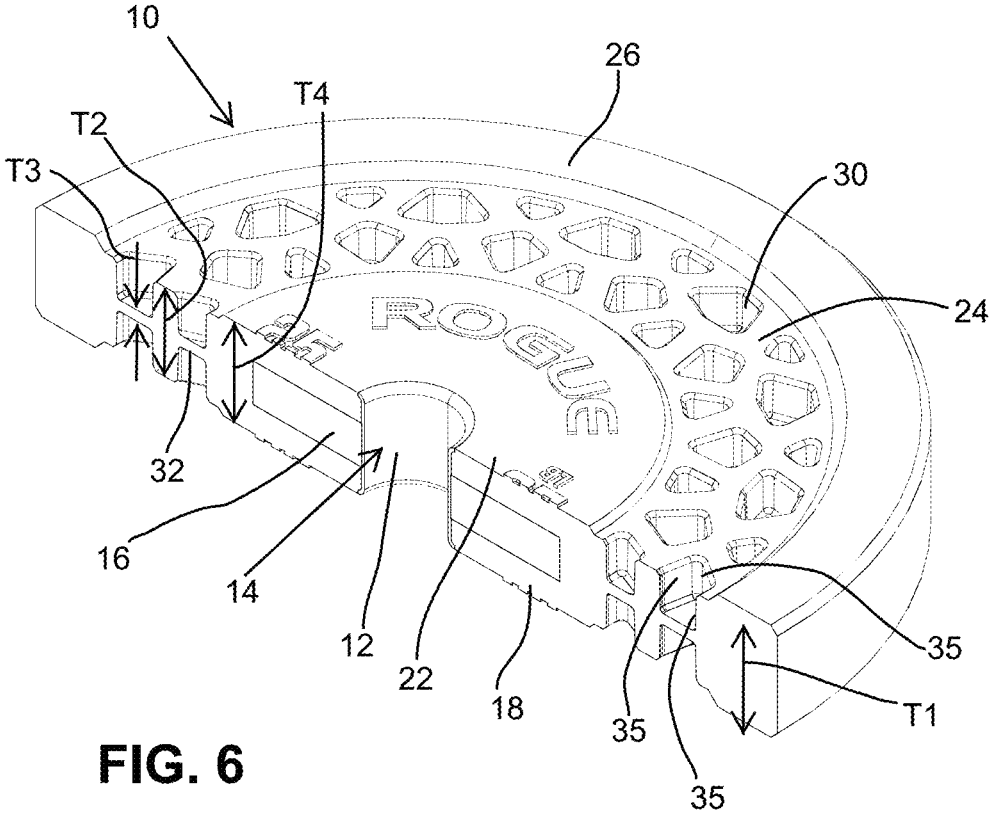
FIG. 6 is a cross-section view of the weight plate of FIG. 5.

The weight plate 10 in FIGS. 1-4 is configured as a 45 lb. weight, and the inner body 16 and the outer body 18 are dimensioned to provide this weight. FIGS. 5-6 illustrate another embodiment of a weight plate 10 configured as a 25 lb. weight, and FIGS. 7-8 illustrate a further embodiment of a weight plate 10 configured as a 35 lb. weight. The weight plates 10 in FIGS. 5-8 are configured similarly to the weight plate 10 in FIGS. 1-4, and the features of the weight plates 10 in FIGS. 5-8 will therefore not be described in detail herein, for the sake of brevity. The mass of the inner body 16 as a proportion of the overall mass of the weight plate 10 may vary depending on the target weight of the weight plate 10. In one embodiment, the weight plate 10 may be a 45 pound weight plate (see FIGS. 1-4), and the ratio of the mass of the inner body 16 to the mass of the outer body 18 is from 0.77 to 1.43, or from 0.94 to 1.27, or about 1.10. In another embodiment, the weight plate 10 may be a 35 pound weight plate (see FIGS. 7-8), and the ratio of the mass of the inner body 16 to the mass of the outer body 18 is from 0.84 to 1.56, or from 1.02 to 1.38, or about 1.20. In a further embodiment, the weight plate 10 may be a 25 pound weight plate (see FIGS. 5-6), and the ratio of the mass of the inner body 16 to the mass of the outer body 18 is from 0.42 to 0.78, or from 0.51 to 0.69, or about 0.60.

The weight plates 10 in FIGS. 1-8 are designed as "bumper plates" that are designed to be dropped from an elevated position, such as when a weightlifting exercise is over. The weight plates 10 in FIGS. 1-8 have different weights with substantially equal outer widths (e.g., radius or diameter) and peripheral sizes (e.g., circumference), and the weight differences are achieved by increasing other dimensions of the inner and/or outer bodies 16, 18, such as the axial thickness. The weight plates 10 in FIGS. 1-8 all have diameters D of about 450 mm, and the radial width W of the outer rim 26 in these plates 10 is about 72 mm, as shown in FIG. 2. The 45 lb. weight plate in FIGS. 1-4 has a maximum axial thickness T1 (at the outer rim) of about 82 mm and a thickness T2 in the areas surrounding the recesses 30 of about 70 mm, the 35 lb. weight plate in FIGS. 7-8 has a maximum axial thickness of about 68 mm and a thickness in the areas surrounding the recesses 30 of about 56 mm, and the 25 lb. weight plate in FIGS. 5-6 has a maximum axial thickness of about 59 mm and a thickness in the areas surrounding the recesses 30 of about 47 mm. The thicknesses T3 of the inner walls 32 in the weight plates 10 in FIGS. 1-8 are all approximately equal at about 6 mm, and the depths of the recesses 30 vary among the different weight plates 10. The weight plates 10 in FIGS. 5-6 have recesses 30 with depths of about 20.5 mm, the weight plates 10 in FIGS. 7-8 have recesses 30 with depths of about 25 mm, and the weight plates 10 in FIGS. 1-4 have recesses 30 with depths of about 32 mm. In one embodiment, the depth of each recess 30 in a weight plate 10 of any size is about 43%-46% of the axial thickness of the area surrounding the recess 30. In another embodiment, the configurations and features described herein may be used in connection with weight plates that have unequal diameters and/or different (e.g., non-circular) peripheral shapes. In a further embodiment, the configurations and features described herein may be used in connection with fixed (non-removable) weights or weight plates, such as weights fixedly attached to the ends of a dumbbell.

Various embodiments of weight plates have been described herein, which include various components and features. In other embodiments, the weight plates may be provided with any combination of such components and features. It is also understood that in other embodiments, the various devices, components, and features of the weight plates described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Terms such as "top," "bottom," "front," "back," "side," "rear," and the like, as used herein, are intended for illustrative purposes only and do not limit the embodiments in any way. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A weight plate comprising:

an outer body formed of a first material, comprising:

an inner section having an annular shape with a passage extending axially through the inner section and configured to receive an elongated member therethrough, the inner section having a first axial thickness;

a middle section having an annular shape and positioned radially outward of the inner section, wherein the middle section includes first and second outer surfaces on opposite axial sides of the outer body, with a second axial thickness defined between the first and second outer surfaces, and a plurality of recesses extending axially inward from the first and second outer surfaces through a portion of the second axial thickness, wherein the plurality of recesses comprise a plurality of first-shaped recesses having a first peripheral shape with a first number of sides and a plurality of second-shaped recesses having a second peripheral shape that is different than the first peripheral shape and with a second number of sides that is different from the first number of sides, and wherein each of the first-shaped recesses on the first outer surface is axially aligned with another of the first-shaped recesses on the second outer surface to form a pair of first-shaped recesses separated by a first inner wall, and each of the second-shaped recesses on the first outer surface is axially aligned with another of the second-shaped recesses on the second outer surface to form a pair of second-shaped recesses separated by a second inner wall; and an outer section having an annular shape and positioned radially outward of the middle section and forming an outer radial periphery of the weight plate, wherein the outer section has a third axial thickness, wherein the first axial thickness and the third axial thickness are greater than the second axial thickness; and an inner body formed of a second material having a larger density and lower flexibility than the first material, wherein the inner body is contained within the inner section of the outer body.

2. The weight plate of claim 1, wherein the outer body surrounds the inner body on at least both axial sides and an outer radial side thereof.

3. The weight plate of claim 1, wherein the inner body is formed of a single piece, and the outer body is molded around the inner body as a single piece.

4. The weight plate of claim 1, wherein the plurality of recesses further comprises a plurality of third-shaped recesses having a third peripheral shape that is different from the first peripheral shape and the second peripheral shape and a third number of sides that is different from the first number of sides and the second number of sides.

5. The weight plate of claim 1, wherein the first-shaped recesses each have a first perimeter defined at the first or second outer surface and a first volume, and the second-shaped recesses each have a second perimeter defined at the first or second outer surface that is different from the first perimeter and a second volume that is different from the first volume.

6. A weight plate comprising:

a first section having an annular shape with a passage extending axially through the first section and configured to receive an elongated member therethrough; and a second section having an annular shape and positioned radially outward of the first section, wherein the second section includes first and second outer surfaces on opposite axial sides of the weight plate with an axial thickness defined between the first and second outer surfaces, a plurality of pentagonal first recesses each extending axially inward from the first outer surface partially through the axial thickness of the second section to a first end recessed from the first outer surface, and a plurality of pentagonal second recesses each extending axially inward from the second outer surface partially through the axial thickness of the second section to a second end recessed from the second outer surface, wherein each of the first recesses is axially aligned with one of the second recesses to form an aligned pair of recesses, such that an inner wall separates the first and second recesses of each aligned pair of recesses and defines the first and second ends of the first and second recesses of each aligned pair of recesses.

7. The weight plate of claim 6, wherein the first and second recesses of each aligned pair of recesses have identical sizes and shapes.

8. The weight plate of claim 6, wherein each of the first recesses and each of the second recesses extend through less than half of the axial thickness of the second section.

9. The weight plate of claim 6, further comprising:

a third section having an annular shape and positioned radially outward of the second section and forming an outer radial periphery of the weight plate, wherein the third section has a greater axial thickness than the second section.

10. The weight plate of claim 6, wherein the second section is positioned immediately radially outward of the first section and is adjacent to the first section.

11. A weight plate comprising:

a first section having an annular shape with a passage extending axially through the first section and configured to receive an elongated member therethrough; and a second section having an annular shape and positioned radially outward of the first section, wherein the second section includes first and second outer surfaces on opposite axial sides of the weight plate with an axial thickness defined between the first and second outer surfaces, a plurality of first recesses each extending axially inward from the first outer surface partially through the axial thickness of the second section to a first end recessed from the first outer surface, and a plurality of second recesses each extending axially inward from the second outer surface partially through the axial thickness of the second section to a second end recessed from the second outer surface, wherein each of the first recesses is axially aligned with one of the second recesses to form an aligned pair of recesses, wherein the first and second recesses of each aligned pair of recesses have identical sizes and shapes, and such that an inner wall separate the first and second recesses of each aligned pair of recesses and defines the first and second ends of the first and second recesses of each aligned pair of recesses, and wherein the plurality of first recesses and the plurality of second recesses each comprise a plurality of first-shaped recesses having a first shape and a plurality of second-shaped recesses having a second shape that is different from the first shape, and wherein each first-shaped recess of the plurality of first recesses is axially aligned with one of the first-shaped recesses of the plurality of second recesses, and each second-shaped recess of the plurality of first recesses is axially aligned with one of the second-shaped recesses of the plurality of second recesses.

12. The weight plate of claim 11, wherein the plurality of first recesses and the plurality of second recesses each further comprise a plurality of third-shaped recesses having a third shape that is different from the first shape and the second shape, and wherein each third-shaped recess of the plurality of first recesses is axially aligned with one of the third-shaped recesses of the plurality of second recesses.

13. A weight plate comprising:

a first section having an annular shape with a passage extending axially through the first section and configured to receive an elongated member therethrough; and a second section having an annular shape with a circular inner periphery and a circular outer periphery and positioned radially outward of the first section, wherein the second section includes first and second outer surfaces on opposite axial sides of the weight plate with an axial thickness defined between the first and second outer surfaces, the second section having a plurality of recesses extending axially inward from the first and second outer surfaces at least partially through the axial thickness of the second section, and wherein the axial thickness of portions of the second section surrounding the recesses is constant between the inner periphery and the outer periphery, wherein a total volume occupied by the plurality of recesses between the first and second outer surfaces is from 20% to 30% of a total volume of solid material in the second section between the inner periphery and the outer periphery, and wherein the plurality of recesses comprises a plurality of first recesses each extending axially inward from the first outer surface partially through the axial thickness of the second section to a first end recessed from the first outer surface, and a plurality of second recesses each extending axially inward from the second outer surface partially through the axial thickness of the second section to a second end recessed from the second outer surface.

14. The weight plate of claim 13, wherein each of the first recesses is axially aligned with one of the second recesses to form an aligned pair of recesses, such that an inner wall separates the first and second recesses of each aligned pair of recesses and defines the first and second ends of the first and second recesses of each aligned pair of recesses.

15. The weight plate of claim 14, wherein the first and second recesses of each aligned pair of recesses have identical sizes and shapes.

16. The weight plate of claim 13, further comprising:

a third section having an annular shape and positioned radially outward of the second section and forming an outer radial periphery of the weight plate, wherein the third section has a greater axial thickness than the second section.

17. The weight plate of claim 16, wherein the second section is positioned immediately radially outward of the first section and is adjacent to the first section, and the third section is positioned immediately radially outward of the second section and is adjacent to the second section, such that the third section extends from the second section to the outer radial periphery of the weight plate.

18. The weight plate of claim 13, wherein each of the plurality of recesses has a constant shape along an entire axial length of the respective recess.

19. A weight plate comprising:

a weight plate body having an outer periphery, a first outer surface and a second outer surface on opposite axial sides of the weight plate body with an axial thickness defined between the first and second outer surfaces, and a passage extending axially through the weight plate body and configured to receive an elongated member therethrough, wherein the first outer surface and the second outer surface extend from the passage radially outward to the outer periphery; and a plurality of recesses extending axially inward from the first and second outer surfaces at least partially through the axial thickness of the weight plate body, wherein the plurality of recesses comprises a plurality of first recesses each extending axially inward from the first outer surface partially through the axial thickness of the weight plate body to a first end recessed from the first outer surface, and a plurality of second recesses each extending axially inward from the second outer surface partially through the axial thickness of the weight plate body to a second end recessed from the second outer surface, and wherein a total volume occupied by the plurality of recesses between the first and second outer surfaces is from 6% to 13% of a total volume of solid material in the weight plate between the passage and the outer periphery.

20. The weight plate of claim 19, wherein each of the first recesses is axially aligned with one of the second recesses to form an aligned pair of recesses, such that an inner wall separates the first and second recesses of each aligned pair of recesses and defines the first and second ends of the first and second recesses of each aligned pair of recesses.

21. The weight plate of claim 20, wherein the first and second recesses of each aligned pair of recesses have identical sizes and shapes.

22. The weight plate of claim 19, wherein the weight plate body comprises:

a first section having an annular shape with the passage extending axially through the first section;

a second section having an annular shape and positioned radially outward of the first section; and a third section having an annular shape and positioned radially outward of the second section and forming an outer radial periphery of the weight plate, wherein the axial thickness is greater at the first section and the third section than at the second section.

23. The weight plate of claim 19, wherein each of the plurality of recesses has a constant shape along an entire axial length of the respective recess.

* * * * *